US005512717A

United States Patent [19]

Magome et al.

[11] Patent Number: 5,512,717

[45] Date of Patent: Apr. 30, 1996

[54] PLUNGER SWITCH

[75] Inventors: Tetsuya Magome; Hiroshi Hayakawa, both of Furukawa, Japan

[73] Assignee: Alps Electric Co., Ltd., Tokyo, Japan

[21] Appl. No.: 306,239

[22] Filed: Sep. 14, 1994

[30] Foreign Application Priority Data

Sep. 17, 1993 [JP] Japan ..... 5-231651

[51] Int. Cl.[6] ..... H01H 9/02

[52] U.S. Cl. ..... 200/295; 200/345; 200/296

[58] Field of Search ..... 200/345, 537, 200/538, 539, 341, 293, 296, 295, 333, 302.1, 520

[56] References Cited

U.S. PATENT DOCUMENTS 3,251,971 5/1966 Fraser ..... 200/223
3,821,529 6/1974 Kallage, Jr. et al. ..... 200/345
4,227,060 10/1980 Ayres et al. ..... 200/296
4,316,065 2/1992 Rupp et al. ..... 200/61.89
5,154,282 10/1992 Pascal ..... 200/345

*Primary Examiner*—David J. Walczak
*Attorney, Agent, or Firm*—Guy W. Shoup; Patrick T. Bever

[57] ABSTRACT

There is provided a plunger switch capable of achieving a self-adjusting mechanism in a simple structure without loss of reliability by mounting a self-adjusting mechanism using a ratchet outside a housing space for movable and fixed contacts. The plunger switch has a switch body divided into blocks, and an attachment member which has a wire spring to be engaged with a ratchet formed on an outer wall of the switch body in order to pierce a plunger therethrough. The switch body is mounted in a predetermined mount position through the attachment member.

9 Claims, 6 Drawing Sheets

PLUNGER SWITCH

BACKGROUND OF THE INVENTION

1. Field of the Invention

The present invention relates to a plunger switch used as a brake lamp switch of an automobile and so on, and more particularly, to a plunger switch having a self-adjusting mechanism capable of automatically adjusting an operating position of a plunger after being mounted in a predetermined mount position.

2. Description of the Related Art

In a plunger switch used as a brake lamp switch of an automobile, a plunger which partly projects from a housing of a switch body is urged by a brake pedal as an outer actuator and a compression spring in the housing, thereby bringing and separating a movable contact, which reciprocates while following the plunger, in contact with and from a fixed contact in the housing to light and put out a brake lamp through a terminal led out from the fixed contact. In other words, since the brake pedal held in a release position by a strong spring force presses the plunger in and separates the movable contact in the housing from the fixed contact, the brake lamp is held in a light-out state at this time. However, when a driver presses on the brake pedal, since the brake pedal is moved in the projecting direction of the plunger, the press-in force is removed. Accordingly, the plunger is pushed back by the compression spring in the housing, the movable contact is brought into contact with the fixed contact, and the brake lamp is lighted.

Even if such plunger switch for a brake lamp is mounted in a predetermined position of a mount panel (bracket), since a non-negligible error is liable to occur in the relative position to the brake pedal, an adjusting mechanism capable of setting the plunger in a proper initial position relative to the brake pedal on and after mounting the plunger switch to the mount panel is needed to operatively connect the plunger switch to the brake pedal with certainty. Various kinds of plunger switches each having such adjusting mechanism have been suggested heretofore, and a plunger switch disclosed in U.S. Pat. No. 4,316,065 is given as an example of conventional art which is provided with a self-adjusting mechanism capable of automatically adjusting an operating position of a plunger after being mounted, has a simple structure and can hold down costs.

In other words, since a movable device for holding a movable contact is connected to a plunger in a housing in this conventional art, the movable contact can be brought into contact with and separated from a fixed contact by reciprocating the movable device through the plunger in the housing. Furthermore, since coupling portions of the plunger and the movable device are formed by a ratchet and a wire spring or the like disengageable from the ratchet, when an overload is applied to the plunger owing to an error in the relative position between the plunger and the brake pedal after the housing is mounted to a mount panel, the plunger is pressed in even after the position of the movable device is regulated, the coupling portions of the plunger and the movable device are displaced from each other, and the plunger is set in the proper initial position for eliminating the error in the relative position to the brake pedal. In short, the operating position of the plunger is automatically adjusted (self-adjust) within the range of the ratchet.

However, since the plunger and the movable device are coupled to each other in the housing of the above-mentioned conventional plunger switch, when the self-adjusting operation is performed and the wire spring or the like is engaged with and disengaged from the ratchet, there is a fear that reliability of the product will be lowered by, for example, faulty conduction caused by the adhesion of shavings of the ratchet to the movable contact and the fixed contact in the housing.

SUMMARY OF THE INVENTION

The present invention aims to solve the above problem of the conventional art, and it is an object of the present invention to provide a plunger switch which can achieve a self-adjusting mechanism in a simple structure without loss of reliability.

In order to achieve the above object, there is provided a plunger switch including a movable contact reciprocating through a plunger piercing through a housing of a switch body and a fixed contact disconnectable from the movable contact in the housing, and a ratchet and an engaging means disengageable from the ratchet as a self-adjusting mechanism for setting the plunger in a proper initial position relative to an outer actuator after the switch body is mounted in a predetermined mount position, the plunger switch further comprising an attachment member having an engaging portion to be engaged with an outer wall portion of the switch body for piercing the plunger therethrough, in which the switch body is mounted in the mount position through the attachment member, the ratchet is formed in one of the engaging portion of the attachment member and the outer wall portion of the switch body, and the engaging means is formed in the other.

If the switch body is mounted in the predetermined mount position through the attachment member to be engaged with the outer wall portion of the switch body, when an overload is applied to the plunger of the switch body because of an error in the relative position between the plunger of the switch body and the outer actuator (for example, a brake pedal) after mounting, since the switch body held by the attachment member through the ratchet is displaced relative to the attachment member in the load direction, the operating position of the plunger is automatically adjusted within the range of the ratchet, and there is no fear that shavings of the ratchet will adhere to the movable contact and the fixed contact in the housing since the shavings are made in the outer wall portion of the switch body during the adjustment.

DESCRIPTION OF THE PREFERRED EMBODIMENTS

Embodiments of the present invention will now be described with reference to the drawings.

Figure 1:
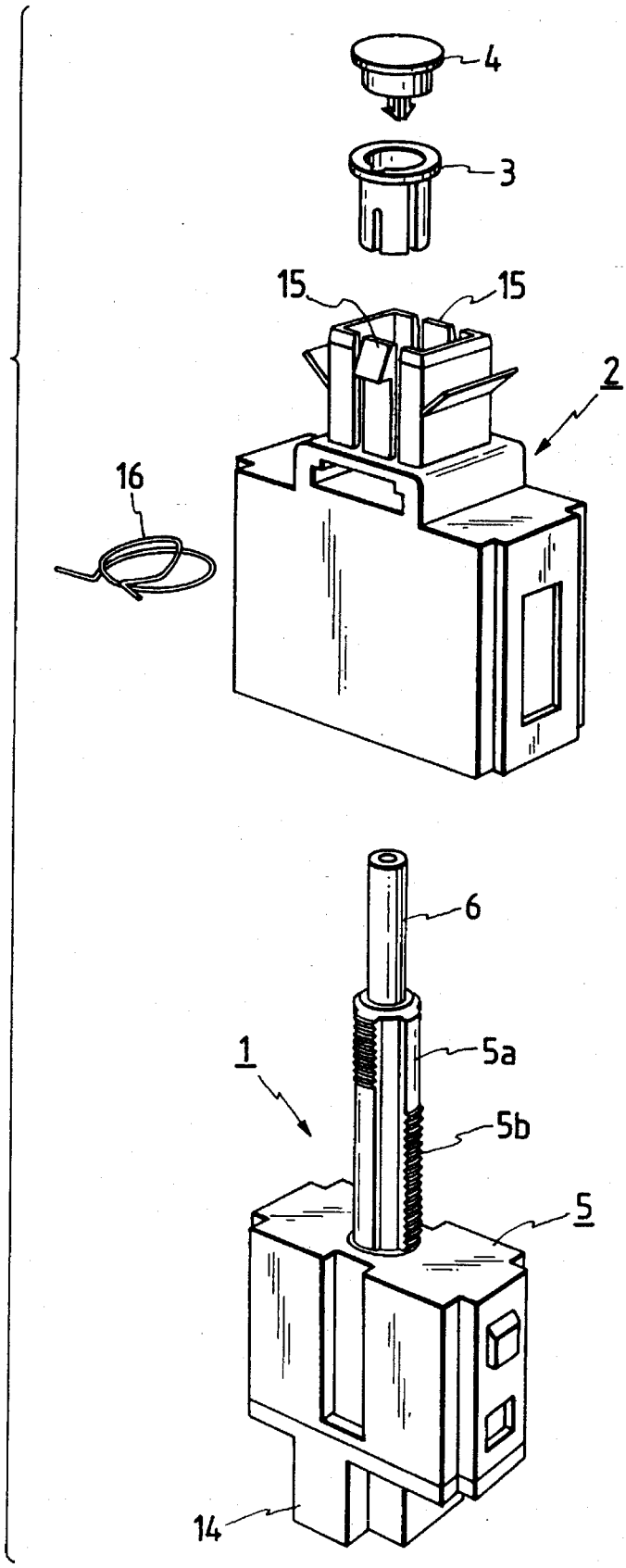
FIG. 1 is an exploded perspective view showing an embodiment of the present invention.
Figure 2:
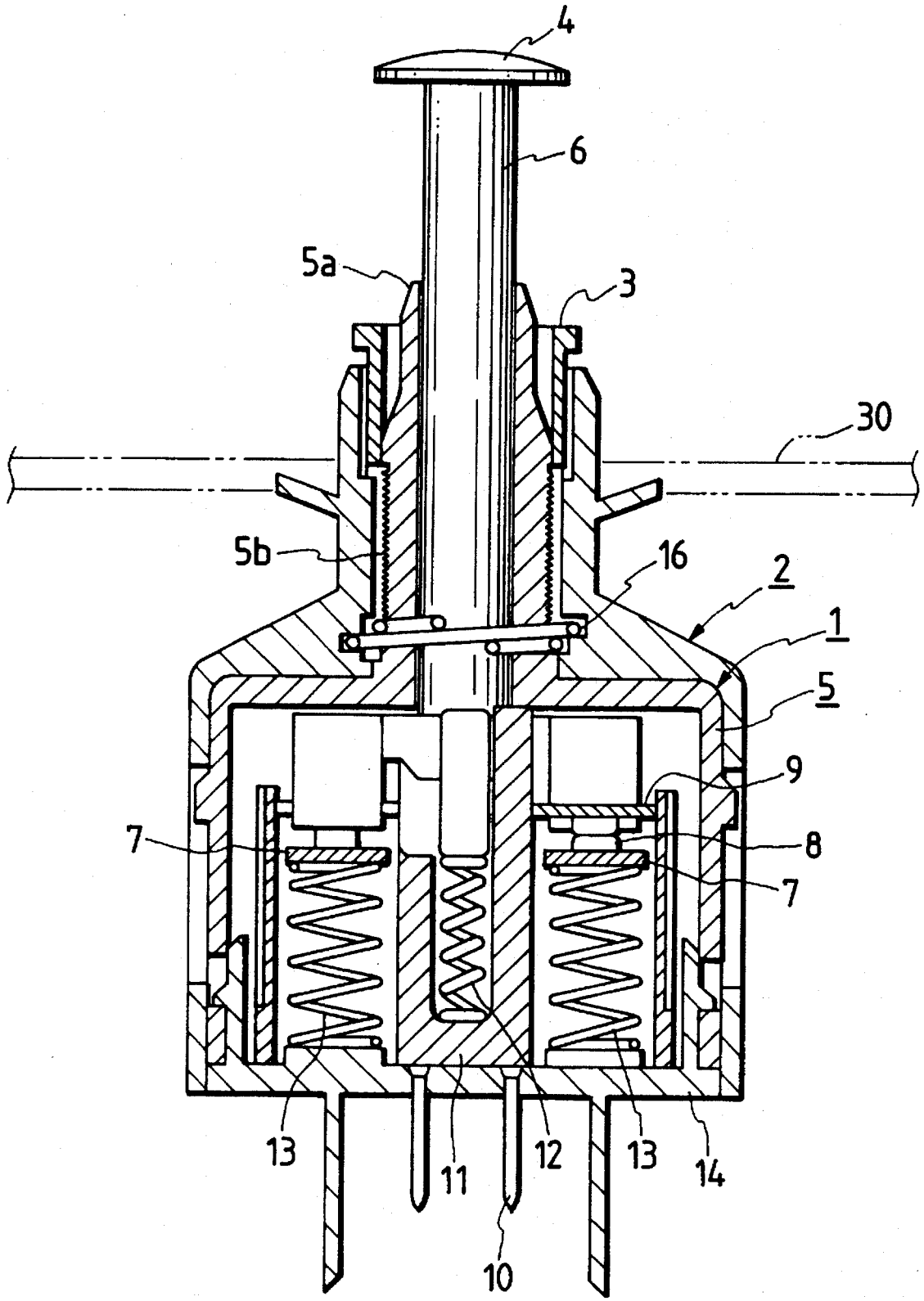
FIG. 2 is a sectional view of the embodiment.
Figure 3:
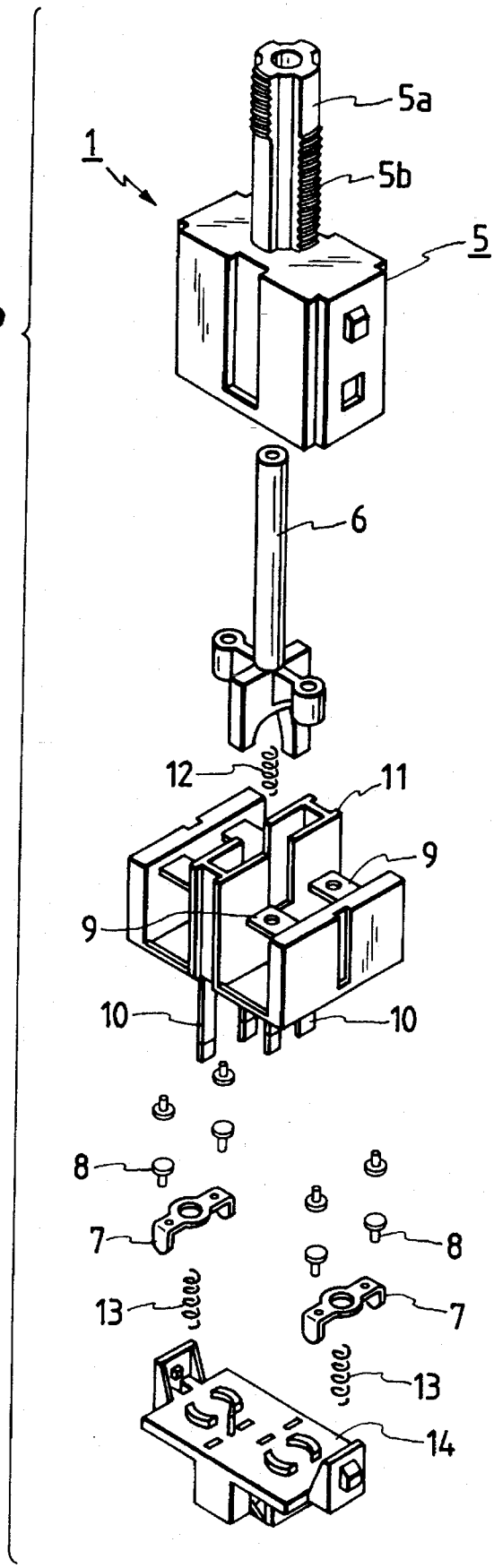
FIG. 3 is an exploded perspective view of a switch body used in the embodiment.

FIG. 1 is an exploded perspective view showing an embodiment of a plunger switch according to the present invention, FIG. 2 is a sectional view of the embodiment, FIG. 3 is an exploded perspective view of a switch body used in the embodiment, and FIG. 4 is a side view explaining a self-locking operation and a self-adjusting operation of the embodiment.

Referring to these figures, the plunger switch is constituted by a switch body 1, an attachment member 2 mounted to an attachment panel 30 for holding the switch body 1, a lock spacer 3 for fixing the attachment member 2 to the attachment panel 30, and a cap 4 to be put on the top of the switch body 1. The switch body 1 is divided into blocks and is, as shown in FIGS. 2 and 3, comprised of a housing 5 having a cylindrical portion 5a projecting therefrom, a plunger 6 piercing through the cylindrical portion 5*a* to be movable reciprocatively, a pair of conductor plates 7 fixed to the bottom of the plunger 6, two pairs of movable contacts 8 being respectively mounted to the conductor plates 7, fixed contacts 9 located above the movable contacts 8, terminals 10 respectively led out from the fixed contacts 9, a wafer 11 formed integrally with the fixed contacts 9 and the terminals 10, a compression spring 12 for urging the plunger 6 upward, a pair of compression springs 13 for respectively urging the conductor plates 7 upward, and a lower cover 14 for covering a bottom opening of the housing 5. Ratchets 5*b* are formed in a plurality of positions on an outer wall of the cylindrical portion 5*a* of the housing 5. On the other hand, a pair of flexible engaging claws 15 are formed on the attachment member 2, and a wire spring 16 is received in a slot formed in the attachment member 2 such that cylindrical portion 5*a* passes through the wire spring 16 when the attachment member 2 is combined with the switch body 1.

Figure 4A:
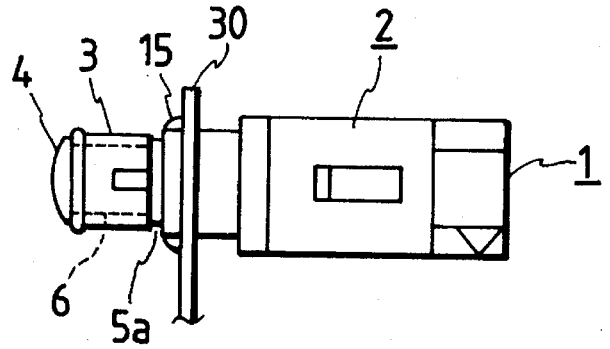
FIGS. 4A and 4B are side views explaining a self-locking operation and a self-adjusting operation in the embodiment.
Figure 4B:
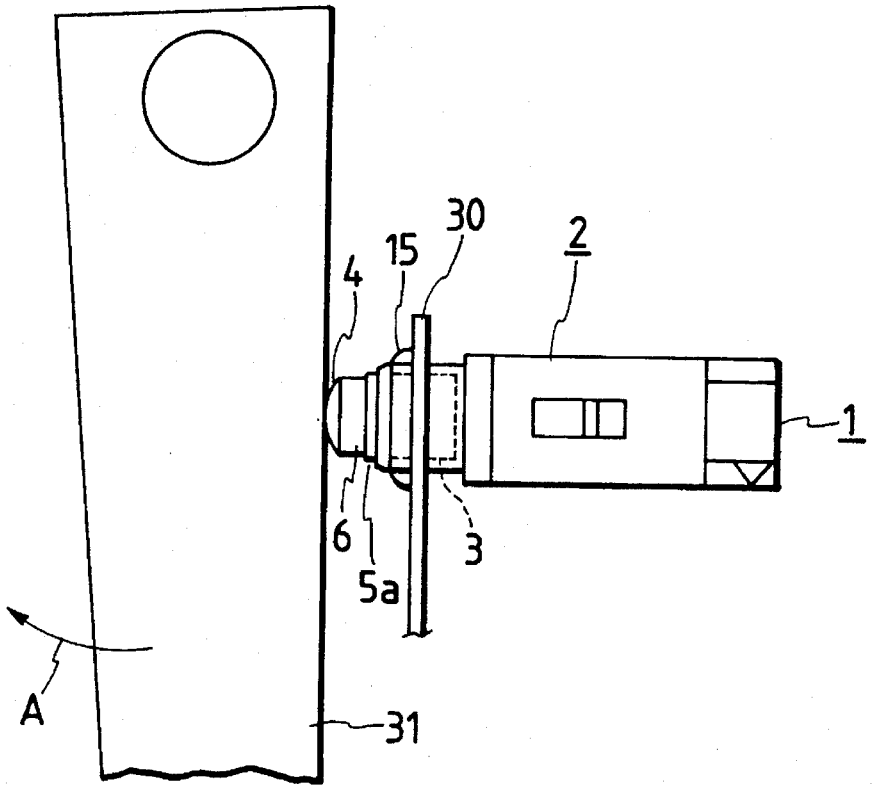

In the plunger switch having such construction, when the cylindrical portion 5*a* of the switch body 1 is inserted from the bottom opening toward the top opening of the attachment member 2 after the switch body 1 is assembled, since the wire spring 16 integrated in the attachment member 2 engages with the ratchets 5*b* formed on the outer wall of the cylindrical portion 5*a*, the switch body 1 and the attachment member 2 can be combined into one. The switch body 1 is strongly pressed in while engaging and disengaging the wire spring 16 with and from the ratchets 5*b*, thereby projecting the cylindrical portion 5*a* from the top opening of the attachment member 2 to the full. After the lock spacer 3 and the cap 4 are mounted on the top of the plunger 6, the attachment member 2 is, as shown in FIG. 4A, attached to the attachment panel 30 by using flexibility of the engaging claws 15. Though the engaging claws 15 can be still flexed inward in a state shown in FIG. 4A immediately after the attachment, when a brake pedal 31 located adjacent thereto and held in a release position by a strong spring force presses in the plunger 6 through the cap 4 once as shown in FIG. 4B, since the lock spacer 3 is put between the engaging claws 15 and the cylindrical portion 5*a* with pressure, the flexture of the engaging claws 15 is limited and the engaging claws 15 are brought into a lock state. The attachment member 2 is firmly fixed to the attachment panel 30 by such self-lock operation, and there is no fear that the attachment member 2 will fall out.

Furthermore, in this plunger switch, since the cylindrical portion 5*a* of the switch body 1 is projected from the top opening of the attachment member 2 to the full in the assembling stage, the plunger 6 is, as shown in FIG. 4A, projected from the attachment member 2 to the full in the leftward direction in the figure immediately after the attachment member 2 is attached to the attachment panel 30. However, when the brake pedal 31 held in the release position by a strong spring force presses in the plunger 6 through the cap 4 once as shown in FIG. 4B, the plunger 6 biased to the side of the pedal 31 is pressed in at the maximum stroke, and then given an overload. The switch body 1 held by the attachment member 2 by engaging the wire spring 16 with the ratchets 5*b* is displaced by a predetermined amount against the engaging force in the load direction by the overload given by the brake pedal 31. In short, the switch body 1 is forcibly retreated by a predetermined amount while keeping the connection to the attachment member 2 fixed to the attachment panel 30. As a result, the plunger 6 of the switch body 1 is set in a proper initial position where the error in the relative position to the brake pedal 31 is eliminated, and the operating position thereof is automatically adjusted within the range of the ratchets 5*b*.

After the self-adjusting operation for setting the plunger 6 in the proper initial position relative to the brake pedal 31 is thus performed, when the brake pedal 31 is held in the release position shown in FIG. 4B and urges the plunger 6 in the rightward direction in the figure, the plunger 6 is held in a state in which it is pressed in at the maximum stroke. Therefore, the movable contacts 8 which follow the plunger 6 in the housing 5 are kept apart from the corresponding fixed contacts 9, and a brake lamp (not shown) is kept in a light-out state. Since the pedal 31 is moved in the direction of the arrow A in FIG. 4B when the driver presses in the brake pedal 31, the pressure exerted on the plunger 6 is removed. Accordingly, the plunger 6 and the conductor plates 7 are pushed back by the compression springs 12 and 13 in the housing 5, the movable contacts 8 are brought into contact with the corresponding fixed contacts 9, and the fixed contacts 9 which form a pair are electrically connected through the conductor plate 7, thereby lighting the brake lamp.

In this embodiment, the plunger switch is constructed by combining the switch body 1 and the attachment member 2 into one through the engagement of the wire spring 16 of the attachment member 2 with the ratchets 5*b* formed on the outer wall of the housing 5 of the switch body 1, and mounting the switch body 1 to the attachment panel 30 through the attachment member 2. The switch body 1 is displaced relative to the attachment member 2 by a predetermined amount in the load direction by making the brake pedal 31 in the release position apply an overload to the plunger 6 of the switch body 1 after the mounting. Therefore, the plunger 6 is set in the proper initial position where the error in the relative position to the brake pedal 31 is eliminated, the self-adjusting operation can be performed within the range of the ratchets 5*b*, and the structure is not complicated since only the attachment member 2 is added. Furthermore, since shavings of the ratchets 5*b* are made on the outer wall portion of the housing 5 of the switch body 1 in the self-adjusting operation, they do not adhere to the movable contacts 8 and the fixed contacts 9 housed in the housing 5, and there is no fear that the self-adjusting operation will impair reliability of the product.

In this embodiment, since the plunger 6 can be biased to the side of the brake pedal 31 to the full and set in a state for ensuring the overload only by projecting the cylindrical portion 5*a* of the switch body 1 from the top opening of the attachment member 2 to the full in the assembling stage before mounting, the self-adjusting operation can be performed with certainty.

Figure 5:
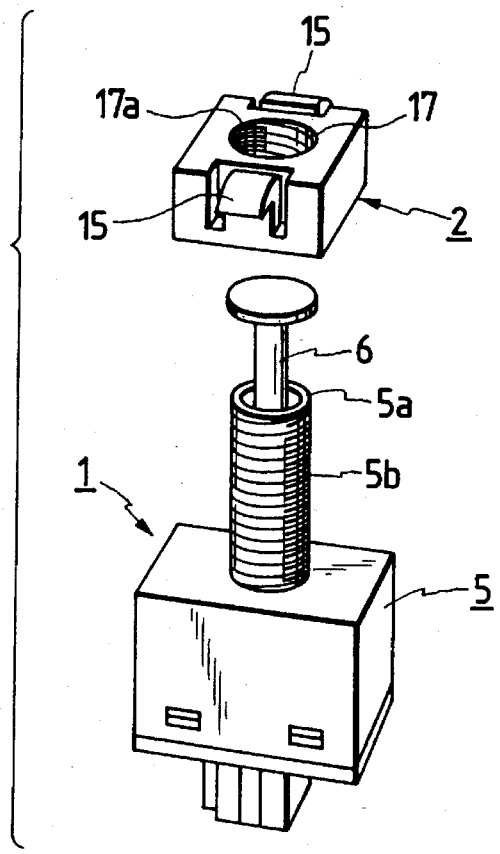
FIG. 5 is an exploded perspective view showing another embodiment of the present invention.

FIG. 5 is an exploded view showing another embodiment of a plunger switch according to the present invention, and components corresponding to those shown in FIG. 1 are denoted by like numerals.

In the plunger switch shown in FIG. 5, an attachment member 2 to be combined with a switch body 1 divided into blocks is provided with a connecting hole 17 having a ratchet 17*a* on an inner wall thereof. A ratchet 5*b* formed on an outer wall of a cylindrical portion 5*a* of the switch body 1 is engaged with the ratchet 17*a* by inserting the cylindrical portion 5*a* from the bottom opening toward the top opening of the connecting hole 17, thereby combining the switch body 1 and the attachment member 2 into one. When an unillustrated brake pedal applies an overload to a plunger 6 after the switch body 1 is attached to an unillustrated attachment panel through the attachment member 2, since the switch body 1 is forcibly retreated by a predetermined amount relative to the attachment member 2 while the ratchet 5*b* engages with and disengages from the ratchet 17*a*, the operating position of the plunger 6 is automatically adjusted within the range of the ratchet 5*b*. Furthermore, there is no fear that shavings of the ratchets 5*b* and 17*a* made in the self-adjusting operation will adhere to movable contacts and fixed contacts in a housing 5. Accordingly, in this embodiment, the same advantage as that of the above embodiment can be expected without additionally mounting any wire spring to the attachment member 2, and the number of components can be reduced.

By projecting the cylindrical portion 5*a* of the switch body 1 from the top opening of the connecting hole 17 of the attachment member 2 to the full in the assembling stage prior to mounting in this embodiment in the similar manner to that of the above embodiment, the plunger 6 can be biased to the side of the brake pedal to the full and set in the state for ensuring the overload when the plunger switch is mounted in a predetermined mount position through flexible engaging claws 15, and the self-adjusting operation can be performed with certainty.

Figure 6:
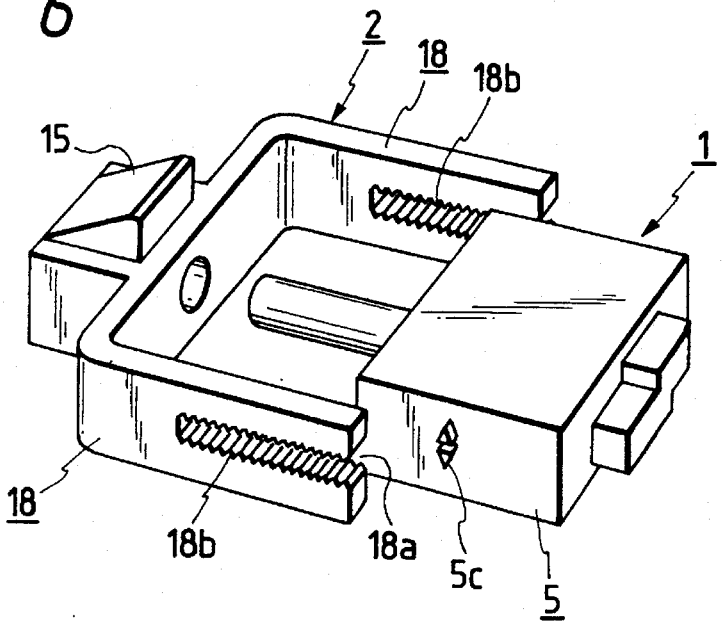
FIG. 6 is an exploded perspective view showing still another embodiment of the invention.

FIG. 6 is an exploded perspective view showing still another embodiment of a plunger switch according to the present invention, and components corresponding to those shown in FIGS. 1 and 5 are denoted by like numerals.

In the plunger switch shown in FIG. 6, an attachment member 2 to be combined with a switch body 1 divided into blocks is provided with a pair of holding walls 18 opposed to each other and each having a slit 18*a* with a ratchet 18*b*, and triangular ribs 5*c* are formed on outer walls of a housing 5 of the switch body 1. The switch body 1 and the attachment member 2 can be combined into one by respectively inserting the triangular ribs 5*c* from open ends of the slits 18*a* to engage with the ratchets 18*b*. After the switch body 1 is mounted to an unillustrated attachment panel through the attachment member 2, when an unillustrated brake pedal applies an overload to a plunger 6, the switch body 1 is forcibly retreated by a predetermined amount relative to the attachment member 2 while the triangular ribs 5*c* are engaged with and disengaged from the ratchets 18*b*. Therefore, the operating position of the plunger 6 is automatically adjusted within the range of the ratchets 18*b*, and there is no fear that shavings of the ratchets 18*b* made during the self-adjusting operation will adhere to movable contacts and fixed contacts in the housing 5. Accordingly, it is also unnecessary in this embodiment to additionally mount a wire spring to the attachment member 2, and it is possible to reduce the number of components thereof.

As described in the above embodiments, the coupling mechanism of the outer wall portion of the switch body 1 (the ratchets 5*b* and the triangular ribs 5*c*) and the engaging portion of the attachment member 2 (the wire spring 16 and the ratchets 17*a* and 18*b*) may be formed by a ratchet and a spring piece such as a wire spring, only ratchets, or a ratchet and a projection like a rib.

Figure 7:
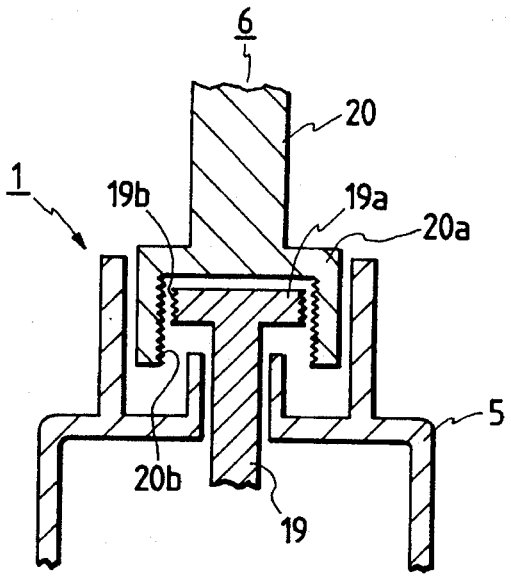
FIG. 7 is a sectional view of the principal part showing a further embodiment of the present invention.

FIG. 7 is a sectional view of the principal part showing a further embodiment of a plunger switch according to the present invention, and components corresponding to those in FIG. 1 are denoted by like numerals.

In the plunger switch shown in FIG. 7, a plunger 6 of a switch body 1 is constructed by a first slider 19 inserted in a housing 5 and followed by unillustrated movable contacts and a second slider 20 having a coupling portion 20*a* fitted on a head portion 19*a* of the first slider 19 located outside the housing 5. Ratchets 19*b* and 20*b* are respectively formed on side surfaces of the head portion 19*b* and inner side surfaces of the coupling portion 20*a*, both surfaces being opposed to each other, and engaged with each other, thereby coupling the first and second sliders 19 and 20. In this plunger switch, the housing 5 of the switch body 1 can be directly mounted in a predetermined mount position without combining the switch body 1 with an attachment member as distinct from the above embodiments. When an unillustrated brake pedal applies an overload to the plunger 6 having a coupling structure after the mounting, a self-adjusting operation is performed and the plunger 6 is set in a proper initial position relative to the brake pedal. In other words, when the overload is applied to the plunger 6 after the mounting, the second slider 20 is pressed in by a predetermined amount even after the position of the head portion 19*a* of the first slider 19 is regulated by the housing 5, and the coupling portions of the sliders 19 and 20 are displaced from each other while the ratchets 20*b* are engaged with and disengaged from the ratchets 19*b*. Therefore, the operating position of the plunger 6 is automatically adjusted within the range of the ratchets 20*b*. Furthermore, since shavings of the ratchets 19*b* and 20*b* are made outside the housing 5 in the self-adjusting operation, there is no fear that the shavings will adhere to the movable contacts and fixed contacts in the housing 5.

The coupling mechanism of the head portion 19*a* of the first slider 19 and the coupling portion 20*a* of the slider 20 may be formed by a ratchet and a spring piece like a wire spring, or a ratchet and a projection like a rib.

Figure 8:
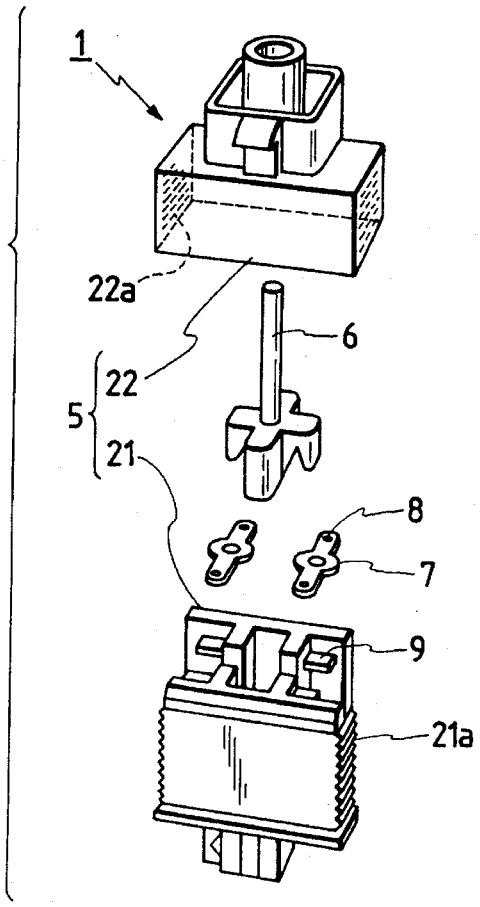
FIG. 8 is an exploded perspective view showing a still further embodiment of the present invention.

FIG. 8 is an exploded perspective view showing a still further embodiment of a plunger switch according to the present invention, and components corresponding to those in FIG. 1 are denoted by like numerals.

In the plunger switch shown in FIG. 8, a housing 5 of a switch body 1 is constituted by a first case 21, in which conductor plates 7 having movable contacts 8, and fixed contacts 9 are housed, and a second case 22 for covering the first case 21 and mounted in a predetermined mount position while making a plunger 6 pierce therethrough. Outer wall portions of the first case 21 and inner wall portions of the second case 22 are opposed to each other and respectively provided with ratchets 21*a* and 22*a*. Both cases 21 and 22 are combined by engaging these ratchets 21*a* and 22*a*. In short, the switch body 1 can be also directly mounted in the predetermined mount position without being combined with an attachment member in this plunger switch. After the second case 22 covering the first case 21 is attached to an unillustrated attachment panel, when an unillustrated brake pedal applies an overload to the plunger 6 projecting from the case 22, the coupling portions of the cases 21 and 22 are displaced from each other while the ratchets 21*a* are engaged with and disengaged from the ratchets 22*a*, and the first case 21 is forcibly retreated relative to the second case 22 by a predetermined amount. Therefore, the operating position of the plunger 6 is automatically adjusted within the range of the ratchets 22*a*. Furthermore, since shavings of the ratchets 21*a* and 22*a* are made in an outer wall portion of the first case 21 in the self-adjusting operation, there is no fear that the shavings will adhere to the movable contacts 8 and the fixed contacts 9 housed in the case 21.

A coupling mechanism of the outer wall portion of the first case 21 and the inner wall portion of the second case 22, these cases constituting the housing 5, may be formed by a ratchet and a spring piece such as a wire spring, or a ratchet and a projection such as a rib.

As described above, the plunger switch of the present invention is provided with a self-adjusting mechanism, which uses a ratchet to set a plunger in a proper initial position relative to an outer actuator after mounted in a predetermined attachment position, located outside a housing for housing movable and fixed contacts, and the operating position of the plunger can be automatically adjusted by the self-adjusting mechanism. Therefore, there is no fear that shavings made in the ratchet in the adjustment will adhere to the movable and fixed contacts in the housing and bring about faulty conduction. Furthermore, there is no need to complicate the structure of the self-adjusting mechanism. Accordingly, it is advantageous that an excellent self-adjusting mechanism can be realized without loss of reliability and with restricting the rise of costs, and it is possible to provide a plunger switch having extremely great practical value in the application to a brake lamp switch of an automobile and so on.

We claim:

1. A plunger switch comprising:

a housing;

a cylindrical portion attached to a wall of the housing and extending away from the housing;

a plunger slidably mounted in said cylindrical portion and including an end portion extending into an interior of the housing;

a switch body including a movable contact housed in said housing and attached to the end portion of said plunger, and a fixed contact housed in said housing and positioned to engage with and separate from said movable contact in response to sliding of said plunger in said cylindrical portion; and an attachment member which mates with opposed sidewalls of said housing for mounting said housing to a device having an outer actuator, wherein a ratchet is formed on one of an outer wall portion of said cylindrical portion and said attachment member and wherein, engaging means disengageable from said ratchet is formed on the other of said outer wall portion of said cylindrical portion and said attachment member, and said ratchet and said engaging means function as a self-adjusting mechanism for mounting said switch body to said attachment member and setting said plunger in a proper initial position relative to said outer actuator.

2. A plunger switch according to claim 1, wherein said engaging means is a ratchet.

3. A plunger switch according to claim 1, wherein said engaging means is a spring piece.

4. A plunger switch according to claim 1, wherein said engaging means is a projection.

5. A plunger switch comprising:

a housing having an outer wall defining a first opening, the housing having an interior space;

a hollow stem fixedly connected to the outer wall of the housing, the stem having an outer surface and defining an inner passage, the inner passage being aligned with the first opening of the housing;

a plunger movably mounted in the stem and extending through the opening into the interior space of the housing;

a movable contact fixedly connected to an end of the plunger and located in the interior space of the housing;

a fixed contact fixedly mounted in the interior space of the housing;

an attachment member which mates with opposed sidewalls of said housing and which defines a second opening, the stem being received in the second opening such that the outer surface of the stem slides against an inner surface of the second opening; and a self-adjusting ratchet mechanism for adjustably connecting the housing to the attachment member, the self-adjusting mechanism being located outside of both the housing and the stem such that particles generated by the self-adjusting mechanism are prevented from depositing between the movable contact and the fixed contact.

6. The plunger switch of claim 5, wherein the self-adjusting ratchet mechanism comprises a plurality of ratchet teeth formed on an exterior surface of the stem, and a spring member mounted on the attachment member for frictionally engaging the plurality of ratchet teeth.

7. The plunger switch of claim 5, wherein the self-adjusting ratchet mechanism comprises a plurality of ratchet teeth formed on an exterior surface of the stem, and a ratchet member formed on the inner surface of the second opening for frictionally engaging the plurality of ratchet teeth.

8. The plunger switch of claim 5, wherein the self-adjusting ratchet mechanism comprises a plurality of ratchet teeth formed on the attachment member, and a ratchet member formed on an exterior surface of the housing for frictionally engaging the plurality of ratchet teeth.

9. A method for mounting a plunger switch onto a device having an outer actuator, the plunger switch including:

a housing having an outer wall defining a first opening, the housing having an interior space;

a hollow stem fixedly connected to the outer wall of the housing, the stem having an outer surface including a plurality of ratchet teeth, the stem defining an inner passage aligned with the first opening of the housing;

a plunger movably mounted in the stem and extending through the opening into the interior space of the housing;

a movable contact fixedly connected to an end of the plunger and located in the interior space of the housing;

a fixed contact fixedly mounted in the interior space of the housing; and an attachment member defining a second opening and a slot; wherein the method comprising the steps of: mounting a spring member into the slot of the attachment member;

attaching the housing to the attachment member by inserting the stem through the second opening such that the ratchet teeth are engaged with the spring member, the stem being inserted until a portion of the housing abuts the attachment member;

mounting the attachment member on the device; and manipulating the outer actuator to a normal operating position, whereby contact between the outer actuator and the plunger causes the housing to move away from the attachment member to a self-adjusted position.

* * * * *